US011798759B2

(12) United States Patent
Chan et al.

(10) Patent No.: US 11,798,759 B2
(45) Date of Patent: Oct. 24, 2023

(54) KEYBOARD DEVICE

(71) Applicant: Chicony Electronics Co., Ltd., New Taipei (TW)

(72) Inventors: Chun-Chieh Chan, New Taipei (TW); Chao-Chin Hsieh, New Taipei (TW)

(73) Assignee: CHICONY ELECTRONICS CO., LTD., New Taipei (TW)

( * ) Notice: Subject to any disclaimer, the term of this patent is extended or adjusted under 35 U.S.C. 154(b) by 0 days.

(21) Appl. No.: 17/894,300

(22) Filed: Aug. 24, 2022

(65) Prior Publication Data

US 2023/0223215 A1 Jul. 13, 2023

(30) Foreign Application Priority Data

Jan. 11, 2022 (TW) ..... 111101193

(51) Int. Cl.
*H01H 13/705* (2006.01)
*H01H 3/12* (2006.01)

(52) U.S. Cl.
CPC ..... *H01H 13/705* (2013.01); *H01H 3/125* (2013.01)

(58) Field of Classification Search
CPC ..... H01H 13/705; H01H 3/125; H01H 3/12; H01H 3/122; H01H 13/70; H01H 13/7065; H01H 13/84; H01H 13/85; H01H 2215/00
USPC ..... 200/341, 344, 345
See application file for complete search history.

(56) References Cited

U.S. PATENT DOCUMENTS 5,924,553 A * 7/1999 Yeh ..... H01H 3/125 200/344
9,024,217 B2 * 5/2015 Khor ..... H01H 3/125 200/341
9,946,359 B2 * 4/2018 Hou ..... H01H 13/84

FOREIGN PATENT DOCUMENTS

TW M548352 U 9/2017
TW M584012 U 9/2019

* cited by examiner

*Primary Examiner* — Lheiren Mae A Caroc
(74) *Attorney, Agent, or Firm* — Muncy, Geissler, Olds & Lowe, P.C.

(57) ABSTRACT

A keyboard device includes a substrate, a keycap, and a link member. The keycap is disposed on the substrate and provided with a limiting member including a top wall, a bottom wall, and a slide groove. In the slide groove, the top wall has a first guide bevel and the bottom wall has a second guide bevel. The link member is disposed between the substrate and the keycap and includes a slide connection portion and a pivot connection portion. The slide connection portion is slidably disposed in the slide groove, and the pivot connection portion is pivotally connected to the substrate. When the keycap is pressed to move downwardly toward the substrate, the pivot connection portion of the link member is rotated with respect to the substrate, and the slide connection portion slides along the first guide bevel and the second guide bevel.

12 Claims, 6 Drawing Sheets

KEYBOARD DEVICE

CROSS-REFERENCE TO RELATED APPLICATION

This non-provisional application claims priority under 35 U.S.C. § 119(a) to Patent Application No. 111101193 filed in Taiwan, R.O.C. on Jan. 11, 2022, the entire contents of which are hereby incorporated by reference.

BACKGROUND

Technical Field

The instant disclosure relates to an input device, in particular, to a keyboard device.

Related Art

Keyboards are common input devices. Usually, they are used along with daily computer products (such as laptops, notebook computers, smart phones, or tablets), industrial scaled control equipment, or processing equipment for operation or text inputs.

SUMMARY

In general, a keyboard known to the inventor(s) includes a bottom board and a plurality of keycaps disposed on the bottom board, and a connection member (e.g., a scissor-type connection member) is disposed between each of the keycaps and the bottom board. Therefore, when the keycap is pressed, the pressing force can be applied to the keycap uniformly due to the supporting of the connection member.

In the keyboard known to the inventor(s), one end of the connection member is connected to the keycap through a horizontally sliding manner. In detail, during the process of pressing the keycap by a force, one end of the connection member is slid horizontally with respect to the keycap according to the horizontal component of the force applied to the keycap. However, with such configuration, the reaction force of the connection member corresponding to the horizontal component of the force applied to the keycap is insufficient to prevent the keycap from wobbling during the pressing operation.

In view of this, in one embodiment, a keyboard device is provided. The keyboard device comprises a substrate, a keycap, and a link member. The keycap is disposed on the substrate and adapted to move downwardly toward the substrate. The keycap comprises a bottom surface, and the bottom surface faces the substrate and is provided with a limiting member. The limiting member comprises a top wall, a bottom wall, and a slide groove. The slide groove is formed between the top wall and the bottom wall, the top wall has a first guide bevel in the slide groove, and the bottom wall has a second guide bevel in the slide groove. The link member is disposed between the substrate and the keycap. The link member comprises a slide connection portion and a pivot connection portion. The slide connection portion and the pivot connection portion are respectively at two opposite sides of the link member. The slide connection portion is slidably disposed in the slide groove, and the pivot connection portion is pivotally connected to the substrate. When the keycap is pressed to move downwardly toward the substrate, the pivot connection portion of the link member is rotated with respect to the substrate, and the slide connection portion slides along the first guide bevel and the second guide bevel.

Based on the above, in the keyboard device according to one or some embodiments of the instant disclosure, the slide groove of the limiting member has the first guide bevel and the second guide bevel. Therefore, when the keycap is pressed to move downwardly toward the substrate, the slide connection portion of the link member inclinedly slides along the first guide bevel and the second guide bevel. Hence, the force of the limiting member applied to the slide connection portion can be increased, thereby increasing the reaction force of the link member corresponding to the force applied to the keycap. Consequently, during the operation, the possibility of wobbling of the keycap can be greatly reduced, thereby improving the operation feeling of the keyboard device.

BRIEF DESCRIPTION OF THE DRAWINGS

The disclosure will become more fully understood from the detailed description given herein below for illustration only, and thus not limitative of the disclosure, wherein.

DETAILED DESCRIPTION

Embodiments are provided for facilitating the descriptions of the instant disclosure. However, the embodiments are provided as examples for illustrative purpose, but not a limitation to the instant disclosure. In all the figures, the same reference numbers refer to identical or similar elements.

Figure 1:
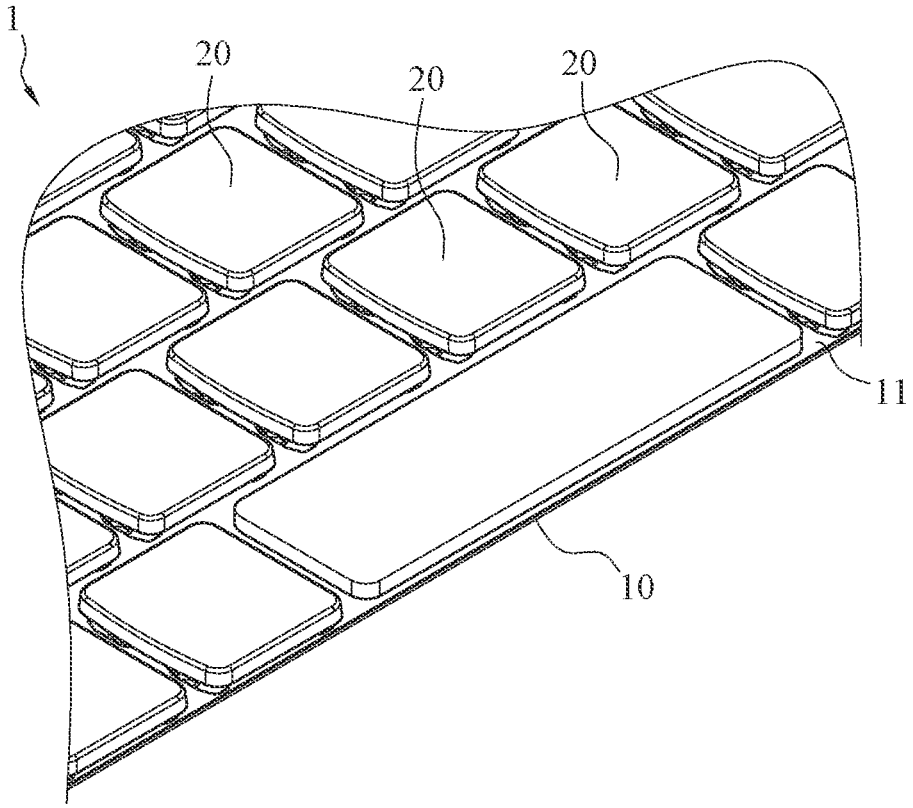
FIG. 1 illustrates a partial perspective view of a keyboard device according to a first embodiment of the instant disclosure.
Figure 2:
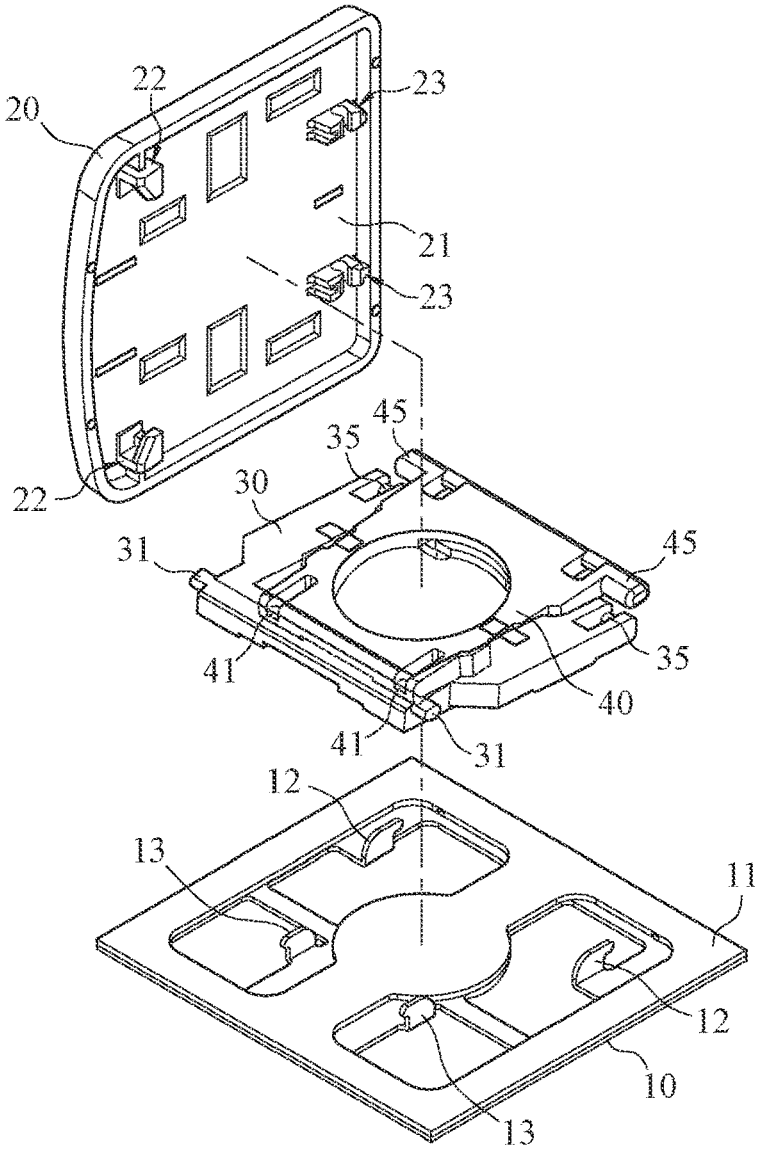
FIG. 2 illustrates a partial exploded view of the keyboard device of the first embodiment.
Figure 3:
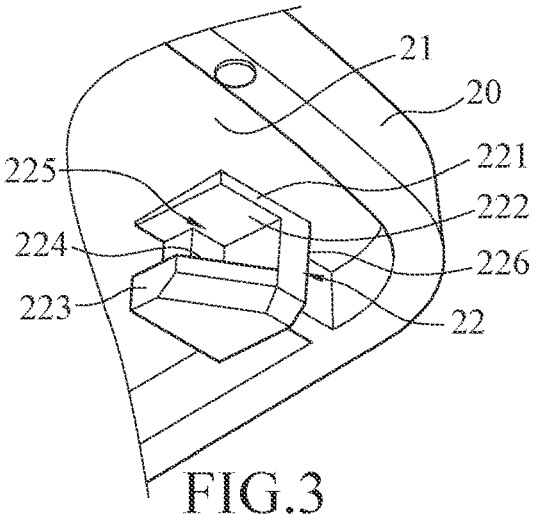
FIG. 3 illustrates an enlarged partial perspective view of the keyboard device of the first embodiment.
Figure 4:
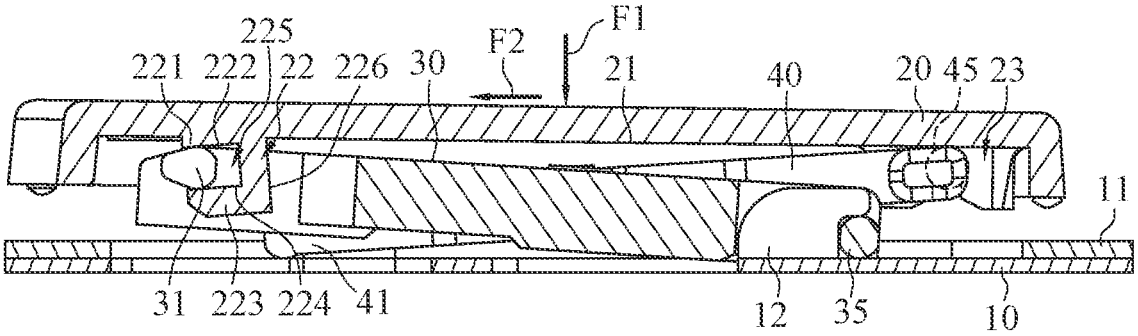
FIG. 4 illustrates a partial cross-sectional view of the keyboard device of the first embodiment.

FIG. 1 illustrates a partial perspective view of a keyboard device 1 according to a first embodiment of the instant disclosure. FIG. 2 illustrates a partial exploded view of the keyboard device 1 of the first embodiment. FIG. 3 illustrates an enlarged partial perspective view of the keyboard device 1 of the first embodiment. FIG. 4 illustrates a partial cross-sectional view of the keyboard device 1 of the first embodiment. With reference to FIG. 1 to FIG. 4. In this embodiment, the keyboard device 1 comprises a substrate 10, a keycap 20, and a link member 30. The keyboard device 1 may be utilized as the input device of various electronic devices (e.g., laptop computers, notebook computers, or input devices of other electronic devices), and users can operate the keyboard device 1 to generate corresponding signal(s).

As shown in FIGS. 1 to 4, in this embodiment, the keyboard device is a computer keyboard. A circuit board 11 may be disposed on the substrate 10. The substrate 10 may be a rigid plate made of metal (e.g., iron, aluminum, and alloy) or plastic material. The circuit board 11 may be a printed circuit board (PCB), a flexible print circuit board (FPCB), a rigid-flex PCB, etc.

As shown in FIG. 1 to FIG. 4, the number of the keycap 20 may be plural, and the keycaps 20 are disposed on the substrate 10 and the circuit board 11. The keycaps 20 may be, for example, the keycaps of the Space key, the Enter key, the Caps Lock key, etc.

As shown in FIG. 1 to FIG. 4, the number of the link member 30 may also be plural, and each of the link members 30 is disposed between the substrate 10 and a corresponding one of the keycaps 20. The link member 30 is adapted to support the keycap 20 and guide the keycap 20 to move upwardly or downwardly with respect to the substrate 10 (as shown in FIG. 2, in this embodiment, an assembly including one keycap 20 and one link member 30 is illustrated for describing the structure and the operation of the keyboard device 1). Moreover, when the keycap 20 is pressed, the keycap 20 is moved downwardly toward the substrate 10 to trigger the circuit board 11 to generate corresponding signal(s). When the keycap 20 is released, the keycap 20 is moved back to its original position (a position that the keycap 20 is not pressed). For example, a plurality of resilient members (not illustrated in the figures) may be disposed on the substrate to correspond to the keycaps 20, and the resilient member may be, for example, a metal dome or a rubber dome. Therefore, when the keycap 20 is released, the keycap 20 can be moved back to its original position through the resilient member.

As shown in FIG. 2 to FIG. 4, the keycap 20 comprises a bottom surface 21. The bottom surface 21 faces the substrate 10 and is provided with at least one limiting member 22 for being assembled with the link member 30. For example, in this embodiment, the bottom surface 21 of the keycap 20 is provided with two limiting members 22, and the two limiting members 22 are respectively adjacent to two corners at the same side of the bottom surface 21 and are spaced apart from each other, but embodiments are not limited thereto. In some embodiments, the bottom surface 21 of the keycap 20 is provided with one limiting member 22, and the other limiting member 22 is replaced by other different limiting structures.

As shown in FIG. 2 to FIG. 4, each of the limiting members 22 comprises a top wall 221, a bottom wall 223, and a slide groove 225. The slide groove 225 is formed between the top wall 221 and the bottom wall 223. In this embodiment, the top wall 221 is connected to the bottom surface 21 of the keycap 20, and the bottom wall 223 is nearer to the substrate 10 as compared with the top wall 221. In other words, in this embodiment, the distance between the bottom wall 223 and the substrate 10 is less than the distance between the top wall 221 and the substrate 10. The limiting member 22 has a connection wall 226 extending along a vertical direction. The connection wall 226 is connected between the top wall 221 and the bottom wall 223 to allow the bottom wall 223 to be spaced apart from the top wall 221, thus the slide groove 225 is formed between the top wall 221 and the bottom wall 223.

Figure 5:
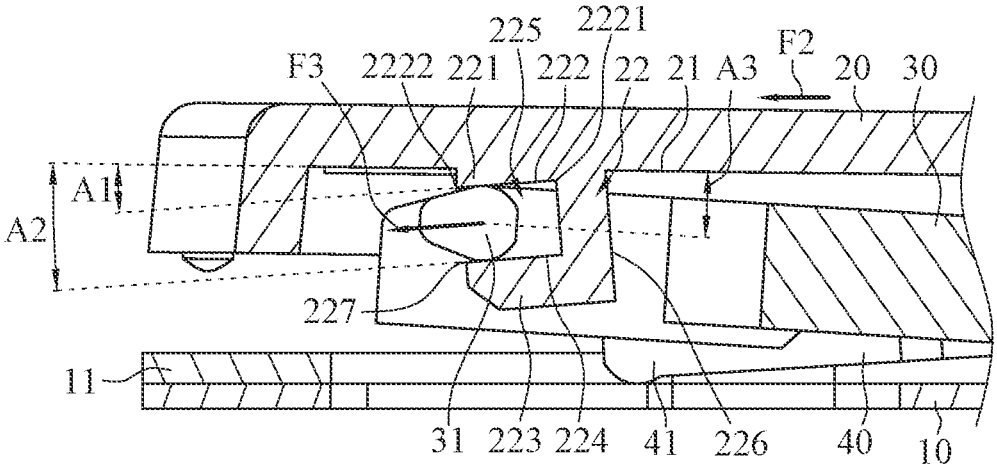
FIG. 5 illustrates an enlarged partial view of FIG. 4.
Figure 6:
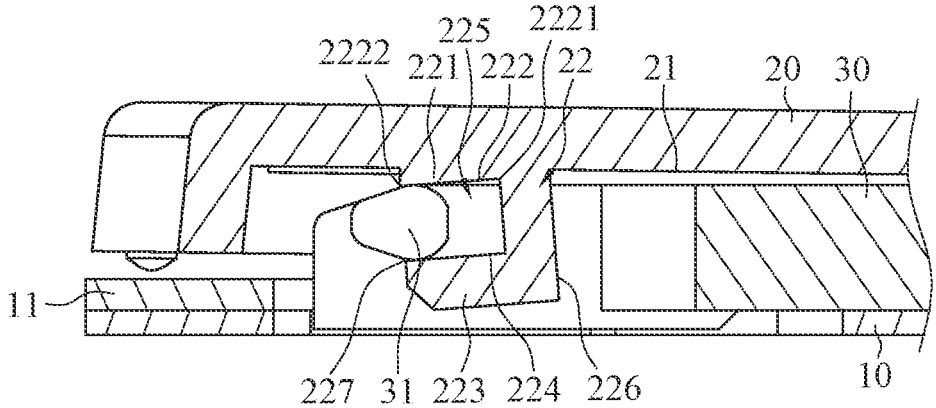
FIG. 6 illustrates a schematic view showing the operation of the keyboard device shown in FIG. 5.

FIG. 5 illustrates an enlarged partial view of FIG. 4. FIG. 6 illustrates a schematic view showing the operation of the keyboard device 1 shown in FIG. 5. As shown in FIG. 4 to FIG. 6, the top wall 221 of the limiting member 22 has a first guide bevel 222 in the slide groove 225, and the bottom wall 223 of the limiting member 22 has a second guide bevel 224 in the slide groove 225. In other words, in this embodiment, the first guide bevel 222 is formed as the upper surface of the slide groove 225, and the second guide bevel 224 is formed as the lower surface of the slide groove 225. Moreover, in one embodiment, a first angle A1 is between the first guide bevel 222 and the bottom surface 21 of the keycap 20, and a second angle A2 is between the second guide bevel 224 and the bottom surface 21 of the keycap 20. In other words, in this embodiment, the first guide bevel 222 and the second guide bevel 224 are not parallel to the bottom surface 21 of the keycap 20.

In some embodiments, the first angle A1 may be the same as the second angle A2, and the first angle A1 and the second angle A2 are acute angles. Thus, under this configuration, the first guide bevel 222 is parallel to the second guide bevel 224. For example, the first angle A1 and the second angle A2 may be in a range between 1 degree and 45 degrees (e.g., 5 degrees, 20 degrees, 30 degrees, or 40 degrees). Alternatively, in another example, the first angle A1 and the second angle A2 may be in a range between 10 degrees and 15 degrees (e.g., 12 degrees or 14 degrees). The degree of the first angle A1 and the second angle A2 can be determined according to actual product requirements. However, it is understood that, the foregoing embodiments are provided for illustrative purposes, not limitations of the instant disclosure. In some embodiments, the first angle A1 may be different from the second angle A2. For example, the first angle A1 may be slightly different from the second angle A2 owing to the manufacturing tolerance of the limiting member 22, or the first angle A1 may be different from the second angle A2 owing to the shape of the link member 30.

As shown in FIG. 2 and FIG. 4, the link member 30 may be a bar member or a frame (in this embodiment, the link member 30 is a U-shaped bar member, but embodiments are not limited thereto). The link member 30 comprises a slide connection portion 31 and a pivot connection portion 35, and the slide connection portion 31 and the pivot connection portion 35 are respectively at two opposite sides of the link member 30. In this embodiment, the number of the slide connection portion 31 is two to correspond to the number of the limiting member 30. Furthermore, each of the two slide connection portions 31 is a shaft and is disposed in the slide groove 225 of a corresponding one of the two limiting members 22. Therefore, each of the slide connection portions 31 is slidable and rotatable with respect to a corresponding one of the slide grooves 225.

As shown in FIG. 2 and FIG. 4, the pivot connection portion 35 of the link member 30 is a shaft (in this embodiment, the number of the pivot connection portion 35 is two, but embodiments are not limited thereto). The pivot connection portions 35 are pivotally connected to the substrate 10, so that the pivot connection portions 35 are rotatable with respect to the substrate 10. For example, in this embodiment, the substrate 10 is provided with two pivot bases 12 (in this embodiment, the pivot base 12 is L-shaped, but may be U-shaped, T-shaped, or of other shapes). Each of the pivot bases 12 integrally and upwardly extends from the substrate 10, and each of the pivot bases 12 is provided for being pivotally connected to a corresponding one of the pivot connection portions 35.

As shown in FIG. 4 to FIG. 6, in this embodiment, both the top wall 221 and the bottom wall 223 of the limiting member 22 has an inclination angle (for example, the inclination angle may be the same as the first angle A1), so that the limiting member 22 is inclinedly arranged, thus making the slide groove 225 be an inclined slide groove, rather than a horizontal slide groove. Furthermore, when the keycap 20 is not pressed (as shown in FIG. 5), the slide connection portion 31 contacts the first guide bevel 222 and the second guide bevel 224 of the limiting member 22 at the same time.

As shown in FIG. 5 and FIG. 6, when the keycap 20 is pressed by a user to move downwardly toward the substrate 10, the pressing force drives the pivot connection portion 35 of the link member 30 to rotate with respect to the substrate 10 and also drives the slide connection portion 31 to slide along the first guide bevel 222 and the second guide bevel 224. Therefore, the keycap 20 can be moved downwardly to a position for triggering the circuit board 11 properly (as shown in FIG. 6). Furthermore, in this embodiment, the first guide bevel 222 has a first top end 2221 and a first bottom end 2222, and the first top end 2221 is nearer to the bottom surface 21 as compared with the first bottom end 2222. In other words, in this embodiment, the distance between the first top end 2221 and the bottom surface 21 is less than the distance between the first bottom end 2222 and the bottom surface 21. When the keycap 20 is pressed to move downwardly toward the substrate 10, the slide connection portion 31 slides along the first guide bevel 222 and the second guide bevel 224 in a direction from the first top end 2221 to the first bottom end 2222.

Furthermore, as shown in FIG. 5 and FIG. 6, the limiting member 22 further has an opening 227. The opening 227 is in communication with the slide groove 225. Furthermore, the connection wall 226 and the opening 227 are respectively at two opposite sides of the limiting member 22, so that the slide groove 225 is between the connection wall 226 and the opening 227. In this embodiment, the first bottom end 2222 of the first guide bevel 22 is nearer to the opening 227 as compared with the first top end 2221 (that is, in this embodiment, the distance between the first bottom end 2222 and the opening 227 is less than the distance between the first top end 2221 and the opening 227), and the opening 227 is nearer to the side portion of the keycap 20 as compared with the connection wall 226 (that is, in this embodiment, the distance between the opening 227 and the side portion of the keycap 20 is less than the distance between the connection wall 226 and the side portion of the keycap 20). Furthermore, when the keycap 20 is pressed to move downwardly toward the substrate 10, the slide connection portion 31 slides along the first guide bevel 222 and the second guide bevel 224 in a direction from the connection wall 226 to the opening 227.

Based on the above, in the keyboard device 1 according to one or some embodiments of the instant disclosure, the slide groove 225 of the limiting member 22 has the first guide bevel 222 and the second guide bevel 224. Therefore, when the keycap 20 is pressed to move downwardly toward the substrate 10, the slide connection portion 31 of the link member 30 inclinedly slides along the first guide bevel 222 and the second guide bevel 224, rather than sliding horizontally. Hence, the force of the limiting member 22 applied to the slide connection portion 31 can be increased, thereby increasing the reaction force of the link member 30 corresponding to the force applied to the keycap 20. Consequently, during the operation, the possibility of wobbling of the keycap 20 can be greatly reduced, thereby improving the operation feeling of the keyboard device 1. Details about the operation of the keyboard device are further provided below.

Figure 7:
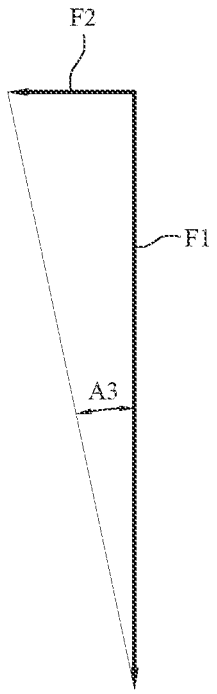
FIG. 7 illustrates a schematic view showing that a force is applied to the keyboard device of the first embodiment.
Figure 8:
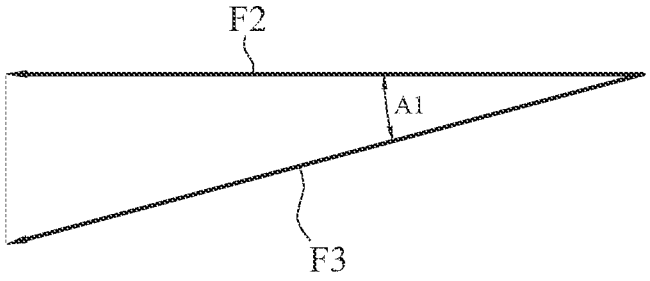
FIG. 8 illustrates another schematic view showing that a force is applied to the keyboard device of the first embodiment.

With reference to FIG. 4, FIG. 5, and FIG. 7. When the keycap 20 is pressed by the user, the pressing force F1 will have a horizontal component F2 applied to the slide connection portion 31 of the link member 30 and the limiting member 22. For example, supposed that the angle A3 between the link member 30 and the bottom surface 21 of the keycap 20 is 12 degrees and the pressing force F1 is 60 g, the horizontal component F2 is about 12.8 g (60 g×tan 12°=12.75 g). Next, with reference to FIG. 4, FIG. 5, and FIG. 8, the slide connection portion 31 of the link member 30 slides along the first guide bevel 222 and the second guide bevel 224 of the limiting member 22, so that the horizontal component F2 applied to the slide connection portion 31 and the limiting member 22 can be increased. For example, supposed that both the first angle A1 between the first guide bevel 222 and the bottom surface 21 and the second angle A2 between the second guide bevel 224 and the bottom surface 21 are 15 degrees, the force of the limiting member applied to the slide connection portion is increased from 12.8 g (the horizontal component F2) to 13.25 g (12.8 g/cos 15°=13.25 g). Moreover, the greater the first angle A1 and the second angle A2 are, the greater the increasing of the force F3 is. Hence, the reaction force of the link member 30 corresponding to the force F3 applied to the keycap 20 can be increased. Consequently, the entire keycap 20 can be moved downwardly when the keycap 20 is forced. Moreover, during the downward movement operation of the keycap 20, the possibility of wobbling of the keycap 20 can be greatly reduced, thereby improving the operation feeling of the keyboard device 1.

As shown in FIG. 2 and FIG. 4. In this embodiment, the keyboard device 1 further comprises a movable member 40. The movable member 40 may be a bar member or a frame (in this embodiment, the movable member 40 is a rectangular frame, but embodiments are not limited thereto). The movable member 40 is disposed between the substrate 10 and the keycap 20 and is pivotally connected to the link member 30. In this embodiment, the size of the link member 30 is greater than the size of the movable member 40. Therefore, the link member 30 is adapted to be fitted over the movable member 40, and the inner side of the link member 30 is pivotally connected to the outer side of the movable portion 40, so that the link member 30 can be expanded or retracted with respect to the movable member 40.

As shown in FIG. 2 and FIG. 4, the movable member 40 comprises a slide portion 41 and a rotation portion 45. The slide portion 41 and the rotation portion 45 are respectively at two opposite sides of the movable member 40. The bottom surface 21 of the keycap 20 is provided with a pivot member 23. The pivot member 23 and the limiting member 22 are respectively adjacent to two opposite sides of the keycap 20. For example, in this embodiment, the number of the pivot member 23 is two, and the two pivot members 23 and the two limiting members 22 are respectively adjacent to four corners of the bottom surface 21. The rotation portion 45 of the movable member 40 is at least one shaft and is pivotally connected to the pivot member 23, so that the rotation portion 45 is rotatable with respect to the substrate 10, and the slide portion 41 of the movable member 40 is slidably disposed on the substrate 10. For example, in this embodiment, the substrate 10 is provided with two slide bases 13 (in this embodiment, the slide base 13 is L-shaped, but may be U-shaped, T-shaped, or of other shapes). Each of the slide bases 13 integrally and upwardly extends from the substrate 10. The number of the slide portion 41 of the movable member 40 is two (in this embodiment, the slide portion 41 is a shaft), and the two slide portions 41 are respectively assembled in the two slide bases 13, so that each of the slide portions 41 is slidable and rotatable with respect to a corresponding one of the slide bases 13.

In some embodiments, the limiting member 22, the pivot member 23, and the keycap 20 may be integrally formed as a one-piece structure. For example, the limiting member 22, the pivot member 23, and the keycap 20 may be integrally formed as a one-piece structure through injection molding. Alternatively, in some embodiments, the limiting member 22 and the pivot member 23 may be fixed on the bottom surface 21 of the keycap 20 through insert molding. Therefore, the limiting member 22 and the pivot member 23 can be made of materials different from the material of the keycap 20. For example, the limiting member 22 and the pivot member 23 may be made of materials with greater rigidity to improve the structural strength of the keyboard device 1.

Figure 9:
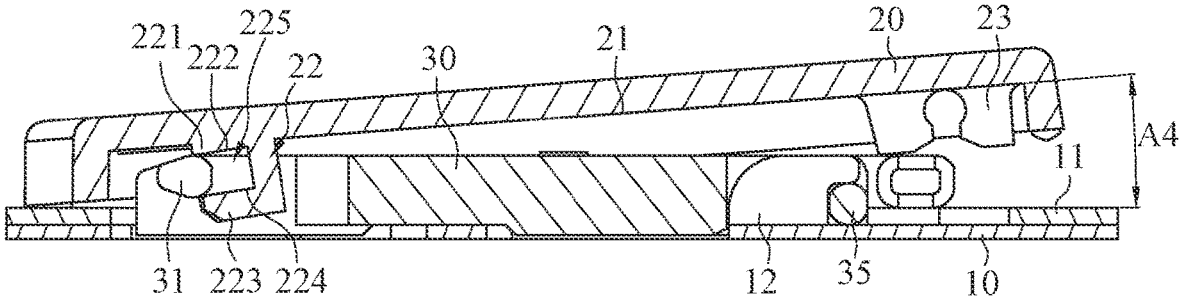
FIG. 9 illustrates a schematic assembled view of the keyboard device of the first embodiment.

FIG. 9 illustrates a schematic assembled view of the keyboard device 1 of the first embodiment. As shown in FIG. 9, according to one or some embodiments of the instant disclosure, the limiting member 22 is inclinedly arranged, thus making the slide groove 225 be an inclined slide groove, rather than a horizontal slide groove. Therefore, during assembling the keycap 20 with the substrate 10 and the link member 30, the assembling angle A4 of the keycap 20 can be further reduced. For example, the assembling angle A4 of the keycap 20 can be reduced from 30 degrees to 15 degrees or less. Hence, the keycap 20 can be assembled in a substantial horizontal manner. Consequently, during the assembling process of the keycap 20, the keycap 20 can be prevented from pushing other components, thereby increasing the product yield of the keyboard device 1.

Figure 10:
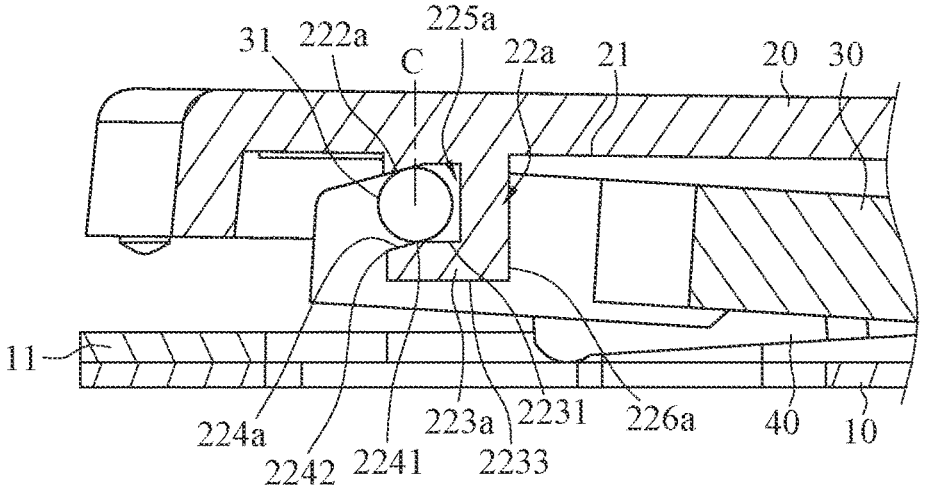
FIG. 10 illustrates a partial cross-sectional view of a keyboard device according to a second embodiment of the instant disclosure.
Figure 11:
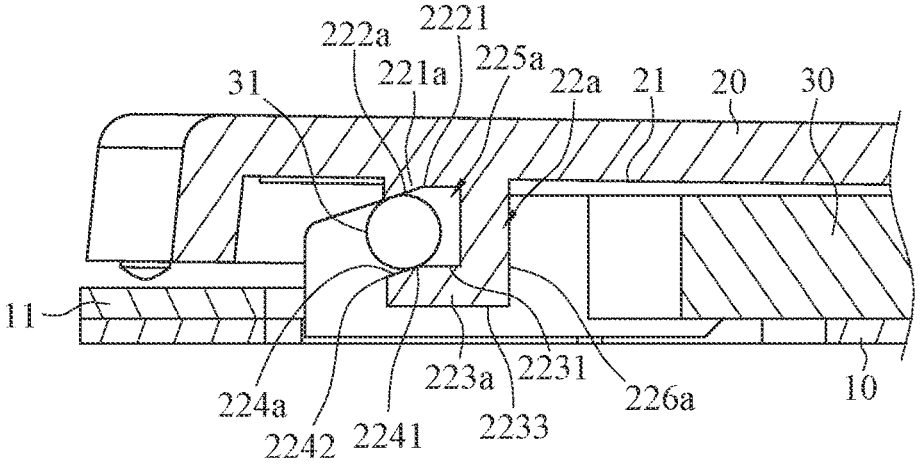
FIG. 11 illustrates a schematic view showing the operation of the keyboard device shown in FIG. 10.

FIG. 10 illustrates a partial cross-sectional view of a keyboard device 1 according to a second embodiment of the instant disclosure. FIG. 11 illustrates a schematic view showing the operation of the keyboard device 1 shown in FIG. 10. As shown in FIG. 10, as compared with the first embodiment, in this embodiment, the bottom wall 223*a* of the limiting member 22*a* is horizontally arranged. Therefore, in this embodiment, the outer surface 2233 of the bottom wall 223*a* outside the slide groove 225*a* is parallel to the bottom surface 21 of the keycap 20. Hence, as shown in FIG. 11, when the keycap 20 is pressed to move downwardly toward the substrate 10 as compared with the inclined bottom wall 233 in the first embodiment, the bottom wall 223*a* of the limiting member 22*a* can be prevented from impacting the components below the keycap 20 (e.g., the substrate 10).

Furthermore, as shown in FIG. 10, in this embodiment, the inner surface of the bottom wall 223*a* of the limiting member 22*a* in the slide groove 225*a* is formed by a flat surface and an inclined surface. Specifically, in this embodiment, the bottom wall 223*a* of the limiting member 22*a* has a flat surface 2231 in the slide groove 225*a*. The second guide bevel 224*a* has a second top end 2241 and a second bottom end 2242. The second top end 2241 is nearer to the bottom surface 21 of the keycap 20 as compared with the second bottom end 2242. In other words, in this embodiment, the distance between the second top end 2241 and the bottom surface 21 of the keycap 20 is less than the distance between the second bottom end 2242 and the bottom surface 21 of the keycap 20. The flat surface 2231 is connected to the second top end 2241 of the second guide bevel 224*a*. Hence, the second top end 2241 is between the second bottom end 2242 and the flat surface 2231, a portion of the slide connection portion 31 is above the flat surface 2231, and the other portion of the slide connection portion 31 is above the second guide bevel 224*a*. For example, in this embodiment, the central axis C of the slide connection portion 31 may be adjacent to the second top end 2241 of the second guide bevel 224*a*, so that a half portion of the slide connection portion 31 is above the flat surface 2231, and the other half portion of the slide connection portion 31 is above the second guide bevel 224*a*. Therefore, as shown in FIG. 11, in this embodiment, when the keycap 20 is pressed to move downwardly toward the substrate 10, the slide connection portion 31 then instantly and inclinedly slides toward the second bottom end 2242 along the first guide bevel 222*a* and the second guide bevel 224*a*. Under this configuration, the force of the limiting member 22*a* applied to the slide connection portion 31 can be increased as well. Consequently, during the operation, the possibility of wobbling of the keycap 20 can be greatly reduced.

Furthermore, as shown in FIG. 10 and FIG. 11, in this embodiment, the inner surface of the top wall 221*a* of the limiting member 22*a* in the slide groove 225*a* is also formed by a flat surface and an inclined surface, and the first top end 2221 of the first guide bevel 222*a* is nearer to the connection wall 226*a* as compared with the second top end 2241 of the second guide bevel 224*a*. In other words, in this embodiment, the distance between the first top end 2221 and the connection wall 226*a* is less than the distance between the second top end 2241 and the connection wall 226*a*. Therefore, when the keycap 20 is not pressed, the slide connection portion 31 contacts the first guide bevel 22*a*. When the keycap 20 is pressed to move downwardly toward the substrate 10, the first guide bevel 222*a* then applies a force to the slide connection portion 31, thereby increasing the force of the limiting member 22*a* applied to the slide connection portion 31.

Figure 12:
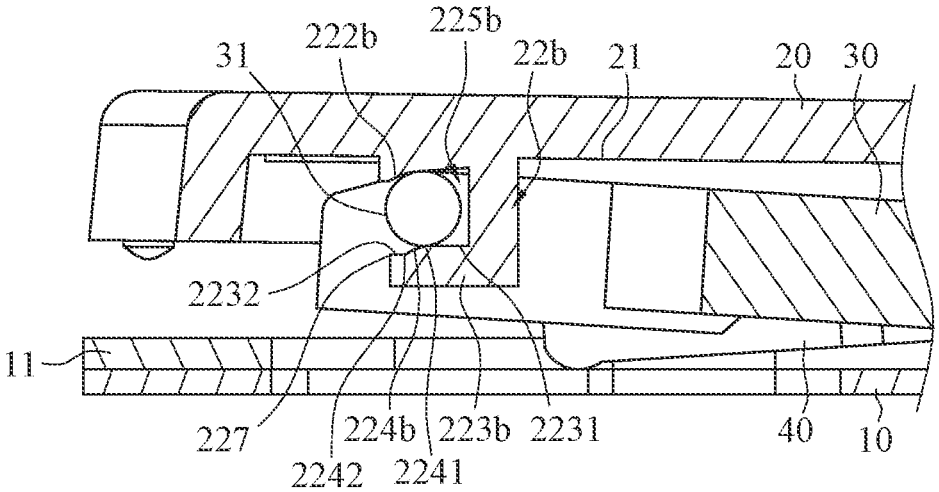
FIG. 12 illustrates a partial cross-sectional view of a keyboard device according to a third embodiment of the instant disclosure.

FIG. 12 illustrates a partial cross-sectional view of a keyboard device 1 according to a third embodiment of the instant disclosure. As shown in FIG. 12, as compared with the second embodiment, in this embodiment, the inner surface of the bottom wall 223*b* of the limiting member 22*b* in the slide groove 225*b* is formed by several flat surfaces and inclined surfaces. Specifically, in this embodiment, the bottom wall 223*b* of the limiting member 22*b* has two flat surfaces 2231, 2232 in the slide groove 225*b*. The flat surface 2231 is connected to the second top end 2241 of the second guide bevel 224*b*, and the flat surface 2232 is connected to the second bottom end 2242 of the second guide bevel 224*b* and extends toward the opening 227. Therefore, the inner surface of the bottom wall 223*b* in the slide groove 225*b* has a stepped structure. Furthermore, in this embodiment, the first guide bevel 222*b* and the second guide bevel 224*b* of the limiting member 22*b* are curved surfaces. In this embodiment, the first guide bevel 222*b* is a concave curved surface, and the second guide bevel 224*b* is a convex curved surface, so that the first guide bevel 222*b* and the second guide bevel 224*b* correspond to the edge of the slide connection portion 31.

Figure 13:
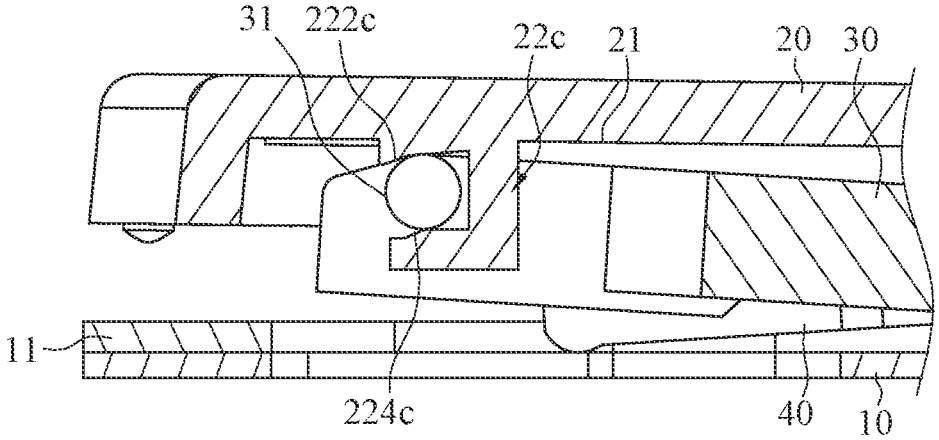
FIG. 13 illustrates a partial cross-sectional view of a keyboard device according to a fourth embodiment of the instant disclosure.

It is understood that, the first guide bevel 222, 222*a*, 222*b* and the second guide bevel 224, 224*a*, 224*b* in any of the aforementioned embodiments may be curved surface or flat surfaces, depending on the actual product requirements. For example, as shown in FIG. 13, which illustrates a partial cross-sectional view of a keyboard device 1 according to a fourth embodiment of the instant disclosure. As compared with the third embodiment, in this embodiment, the first guide bevel 222*c* and the second guide bevel 224*c* of the limiting member 22*c* are flat surfaces, rather than curved surfaces.

Based on the above, in the keyboard device according to one or some embodiments of the instant disclosure, the slide groove of the limiting member has the first guide bevel and the second guide bevel. Therefore, when the keycap is pressed to move downwardly toward the substrate, the slide connection portion of the link member inclinedly slides along the first guide bevel and the second guide bevel. Hence, the force of the limiting member applied to the slide connection portion can be increased, thereby increasing the reaction force of the link member corresponding to the force applied to the keycap. Consequently, during the operation, the possibility of wobbling of the keycap can be greatly reduced, thereby improving the operation feeling of the keyboard device.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A keyboard device comprising:

a substrate;

a keycap disposed on the substrate and adapted to move downwardly toward the substrate, wherein the keycap comprises a bottom surface, and the bottom surface faces the substrate and is provided with a limiting member; the limiting member comprises a top wall, a bottom wall, and a slide groove; the slide groove is formed between the top wall and the bottom wall, the top wall has a first guide bevel in the slide groove, and the bottom wall has a second guide bevel in the slide groove; and a link member disposed between the substrate and the keycap, wherein the link member comprises a slide connection portion and a pivot connection portion; the slide connection portion and the pivot connection portion are respectively at two opposite sides of the link member, the slide connection portion is slidably disposed in the slide groove, and the pivot connection portion is pivotally connected to the substrate;

wherein when the keycap is pressed to move downwardly toward the substrate, the pivot connection portion of the link member is rotated with respect to the substrate, and the slide connection portion slides along the first guide bevel and the second guide bevel.

2. The keyboard device according to claim 1, wherein a number of the limiting member is two, and the two limiting members are spaced apart from each other; a number of the slide connection portion is two, and each of the slide connection portions is slidably disposed in the slide groove of a corresponding one of the limiting members.

3. The keyboard device according to claim 1, further comprising a movable member, wherein the movable member is disposed between the substrate and the keycap, and the movable member is pivotally connected to the link member; the movable member comprises a slide portion and a rotation portion; the slide portion and the rotation portion are respectively at two opposite sides of the movable member; the bottom surface of the keycap is provided with a pivot member; the pivot member and the limiting member are respectively adjacent to two opposite sides of the keycap; the rotation portion of the movable member is pivotally connected to the pivot member, and the slide portion is slidably disposed on the substrate.

4. The keyboard device according to claim 1, wherein a first angle is between the first guide bevel and the bottom surface, and a second angle is between the second guide bevel and the bottom surface; the first angle is the same as the second angle, and the first angle and the second angle are acute angles.

5. The keyboard device according to claim 4, wherein the first angle and the second angle are in a range between 1 degree and 45 degrees.

6. The keyboard device according to claim 5, wherein the first angle and the second angle are in a range between 10 degrees and 15 degrees.

7. The keyboard device according to claim 1, wherein the first guide bevel has a first top end and a first bottom end, the first top end is nearer to the bottom surface as compared with the first bottom end; when the keycap is pressed to move downwardly toward the substrate, the slide connection portion is moved along the first guide bevel and the second guide bevel in a direction from the first top end to the first bottom end.

8. The keyboard device according to claim 1, wherein the bottom wall has an inclination angle, thus making the slide groove be an inclined slide groove.

9. The keyboard device according to claim 1, wherein the first guide bevel and the second guide bevel are curved surfaces.

10. The keyboard device according to claim 1, wherein the bottom wall has an outer surface outside the slide groove, and the outer surface is parallel to the bottom surface of the keycap.

11. The keyboard device according to claim 1, wherein the bottom wall has a flat surface in the slide groove; the second guide bevel has a second top end and a second bottom end, the flat surface is connected to the second top end; a portion of the slide connection portion is above the flat surface, and another portion of the slide connection portion is above the second guide bevel.

12. The keyboard device according to claim 11, wherein the bottom wall has a second flat surface, and the second flat surface is connected to the second bottom end.

* * * * *